US008142336B1

(12) United States Patent
Yates

(10) Patent No.: US 8,142,336 B1
(45) Date of Patent: Mar. 27, 2012

(54) LEG REHABILITATION STRAP

(76) Inventor: Mary Yates, Hardy, AR (US)

( * ) Notice: Subject to any disclaimer, the term of this patent is extended or adjusted under 35 U.S.C. 154(b) by 181 days.

(21) Appl. No.: 12/380,902

(22) Filed: Mar. 5, 2009

(51) Int. Cl.
*A63B 21/02* (2006.01)
*A63B 23/08* (2006.01)

(52) U.S. Cl. ..... 482/124; 482/79

(58) Field of Classification Search ..... 482/79–80, 482/123–125; 128/882; 602/27–28
See application file for complete search history.

(56) References Cited

U.S. PATENT DOCUMENTS 1,734,238 A * 11/1929 Sweeney ..... 482/123
4,329,982 A 5/1982 Heaney
4,566,447 A 1/1986 Deis
4,817,589 A 4/1989 Wertz
5,277,680 A 1/1994 Johnston
5,372,565 A 12/1994 Burdenko
D368,501 S 4/1996 Woodruff
5,518,486 A 5/1996 Sheeler
5,695,437 A 12/1997 Olschansky et al.
5,865,203 A 2/1999 Villano
6,027,434 A 2/2000 Gibbons
6,361,516 B1 * 3/2002 Hamel ..... 602/27
6,361,517 B1 3/2002 Slinger
6,425,844 B1 * 7/2002 Azar ..... 482/79
6,450,930 B1 9/2002 Kroke
6,602,217 B2 8/2003 Crawford et al.
6,790,165 B2 9/2004 Huang

* cited by examiner

*Primary Examiner* — Fenn Mathew
(74) *Attorney, Agent, or Firm* — Montgomery Patent & Deisgn, LLC; Robert C. Montgomery; Joseph T. Yaksich

(57) ABSTRACT

An apparatus to assist a user in the bending or moving of their knee/leg area that can be used to increase mobility and/or perform rehabilitation exercises is herein disclosed, comprising a unitary piece of heavy textile, and a central strap provided about the upper half of one (1) side. In such a manner the strap forms a sling-like arrangement which holds the textile fabric about the bottom of one's foot. A long nylon strap is centrally provided on the bottom of the fabric where it is bisected by the arch of one's foot. To use the apparatus, the user simply slips their foot onto the textile sling, and grabs the two (2) loose ends of the long strap. Next, by lifting up on the strap, the user can aid in the movement of one's leg to simulate motion and resistance and thus aid in the rehabilitation of the leg and knee muscles.

14 Claims, 6 Drawing Sheets

LEG REHABILITATION STRAP

RELATED APPLICATIONS

The present invention was first described in a notarized Official Record of Invention on Mar. 14, 2008, that is on file at the offices of Montgomery Patent and Design, LLC, the entire disclosures of which are incorporated herein by reference.

FIELD OF THE INVENTION

The present invention relates generally to an apparatus to assist a user in bending or moving their knee/leg area and, more particularly, to said apparatus increasing mobility and/or assisting in rehabilitation exercises.

BACKGROUND OF THE INVENTION

When one has a lower leg impairment such as drop foot, activities such as climbing stairs or bending over to tie one's shoes require extreme physical exertion. Other activities such as rehabilitation exercises often require the assistance of others which may delay recovery due to lack of help. Accordingly, there is a need for a means by which those who suffer leg and/or knee disabilities can be afforded a means to lift their legs in an assisted manner to overcome the difficulties as described above. The development of the apparatus described herein fulfills this need.

There have been attempts in the past to invent leg rehabilitation devices. U.S. Pat. No. D 368,501 issued to Woodruff discloses a flexible exerciser that appears to comprise a continuous strap with handles on both ends. Unfortunately, this design patent does not appear to be similar in appearance to the disclosed apparatus, nor does it appear to comprise a central receiving portion for the placement of a user's foot.

U.S. Pat. No. 6,790,165 issued to Huang discloses a rehabilitation aid that appears to comprise a leg sleeve, an adjusting means connected to a front side of the leg sleeve, a spring connected at an end to the adjusting means, and a foot strap connected to another end of the spring. Unfortunately, this patent does not appear to disclose a leg rehabilitation device that can be manipulated by a user's hands to assist in movement of the lower leg.

U.S. Pat. No. 6,602,217 issued to Crawford et al discloses a foot drop assistance device comprising a leg member and a strap having a first end supportable between the big toe and an adjacent end and a removable attachment mechanism for attaching the second end to the leg member. Unfortunately, this patent does not appear to disclose a central member portion which is padded and accepts the placement of a user's foot to which are attached straps with loops that may be used to manipulate the device to aid in movement of a user's lower leg.

U.S. Pat. No. 6,450,930 issued to Kroke discloses a rehabilitation strap system that appears to comprise an elongate main strap secured at opposing ends forming a loop having a first side and a second side, a pair of upper handles attached to the main strap, a pair of lower handles attached to the main strap, and a plurality of rungs attached between the first side and the second side of the main strap. Unfortunately, this patent does not appear to disclose a central-receiving portion with a friction resistant surface and comfortable padding for accepting the foot of a user.

U.S. Pat. No. 6,361,517 issued to Slinger discloses a foot lift assist that appears to comprise an elastic strap that is attached to a person's belt. Unfortunately, this patent does not appear to disclose a leg rehabilitation device that comprises a central-receiving portion and a pair of straps that further comprise loops at the ends so that the device may be manipulated by a user via their hands.

U.S. Pat. No. 6,027,434 issued to Gibbons discloses a device for relieving leg cramps that appears to comprise a "D"-shaped handle into which a user can place the instep of their foot and a continuous tubular shaft. Unfortunately, this patent does not appear to disclose a leg rehabilitation device that comprises a central-receiving portion and two (2) attached straps, nor does it appear to be useful for manually assisting in moving one's lower leg.

U.S. Pat. No. 5,865,203 issued to Villano discloses a hand-held extensor for assistance with walking and rehabilitation that appears to comprise a foot stirrup assembly, a lower strap attached to the top of foot stirrup assembly and an upper strap with a handle mounted thereon that may be gripped by a user to allow the user to pull upwardly on the handle to raise the foot stirrup assembly. Unfortunately, this patent does not appear to disclose a padded central-receiving portion with a friction surface, nor does it appear to comprise two (2) straps with loops for handles.

U.S. Pat. No. 5,695,437 issued to Olschansky discloses a gluteal and thigh muscle exercise system comprising a longitudinally extended handle member and assembly for engaging a heel portion of a user's foot. A resistive force assembly is coupled on a first end to a central portion of the handle member and on an opposing second end to the heel engagement assembly. Unfortunately, this patent does not appear to disclose a comfortable central-receiving portion for accepting a user's foot, nor does it appear to disclose a device that would be useful for assisting individuals with impairment of lower leg functions in moving their limbs.

U.S. Pat. No. 5,518,486 issued to Sheeler discloses an exercise strap device comprising a harness with an adjustable flexible, inelastic strap with an adjustable foot loop at one end and a hand grip at the other end. Unfortunately, this patent does not appear to disclose a leg rehabilitation device that comprises a central-receiving portion and a pair of straps that further comprise loops at the ends so that the device may be manipulated by a user via their hands.

U.S. Pat. No. 5,372,565 issued to Burdenko discloses a universal exercise device comprising a belt portion with rings for the attachment of elastic straps which are connected to the hands, legs, and head of the user to use in various exercises based on the application of force required for the stretching of the elastic straps. Unfortunately, this patent does not appear to disclose a device that is useful for aiding in the movement of a user's lower leg by looped straps which a user can move with their hands.

U.S. Pat. No. 5,277,680 issued to Johnston discloses a therapeutic leveraging device comprising a means for grasping a foot, a first female buckle assembly, a second female buckle assembly, a line cord, and ten (10) separate means for guiding the line cord. Unfortunately, this patent does not appear to disclose a device that comprises a receiving portion for a user's foot that is attached to a pair of looped straps that permits a user to use their hands to assist in the movement of an impaired lower limb.

U.S. Pat. No. 4,817,589 issued to Wertz discloses a foot support device for improved ambulation comprising a support member adapted to engage a posterior ankle section of the leg and having strap means for providing dorsiflexion and eversion assistance and the strap is attached to predetermined points on a user's shoe. Unfortunately, this patent does not appear to disclose a device that is useful for aiding in the movement of a user's lower leg by looped straps which a user can move with their hands.

U.S. Pat. No. 4,566,447 issued to Deis discloses a drop foot corrective device that comprises a leg band that girdles the leg providing an anchor point for the upper end of a ligament having its lower end attached to a toe of a shoe or a toe on the foot to support the foot and retain the foot in a normal position during walking. Unfortunately, this patent does not appear to disclose a centrally padded portion that accepts a user's foot that is connected to looped straps for manually assisting a lower limb.

U.S. Pat. No. 4,329,982 issued to Heaney discloses an orthotic foot assist apparatus that comprises a leg attachment member, an elastomeric support strap, and a latch and loop for attaching the support strap to the wearer's foot. Unfortunately, this patent does not appear to disclose a device capable of being manually used to manipulate a user's foot during walking and other activities.

SUMMARY OF THE INVENTION

In light of the disadvantages as described in the prior art, it is apparent that there is a need for a leg rehabilitation strap comprising a padded receiving member that removably receives and retains a foot of the user to assist said user in the bending or motioning of the knee and/or leg area that can be used to increase mobility and/or perform rehabilitation exercises.

An object of the leg rehabilitation strap comprises a central-receiving member fabricated of heavy-duty textiles such as nylon, canvas, and/or a combination thereof.

Another object of the leg rehabilitation strap comprises a variety of aesthetically pleasing decor and/or motifs with or without images such as, but not limited to, cartoon characters, sport logos, and/or other caricatures.

A further object of the leg rehabilitation provides for various sizes and shapes so that multiple users comprising various foot sizes may benefit.

Still another object of the leg rehabilitation strap provides a means to assist a user in the bending or moving of their knee and/or leg area to increase mobility and/or perform rehabilitation exercises.

Still a further object of the leg rehabilitation strap may be utilized by a user positioned as sitting, prone, or standing.

Yet another object of the leg rehabilitation strap comprises a handle that includes a padded material which functions to provide the user additional comfort, which will contribute to allowing the user to extend the duration of walks.

Yet a further object of the leg rehabilitation strap permits upward, downward, sideward, and circular motion of the foot thereby providing optimum strengthening and conditioning exercises.

Still another object of the leg rehabilitation strap permits a user to move their foot against the resistance of the elastic straps resulting in a healthy increase of strength to the muscles, tendons, and ligaments surrounding the knee and/or leg area.

An aspect of the leg rehabilitation strap comprises a rectangular central-receiving member. The central-receiving member and the foot strap are constructed of a sewn cover to enclose a padding material for a cushioning comfort effect. The central-receiving member comprises a frictional engagement members which functions to prevent slippage on a floor surface and a layer of padding covering the entire interior surface.

A further aspect of the leg rehabilitation strap comprises a foot strap that forms a sling-like arrangement to hold the textile fabric about the bottom of a user's foot. A foot strap is integrally attached to the central-receiving member and encloses the foot thereon the central-receiving member. The foot strap comprises a distal end and a proximal end and are attached to the upper side surface of the central-receiving member.

The symmetric placement of the two (2) straps on opposite sides of the central receiving member acts to balance the leg rehabilitation strap to provide equal amount of force thereon the leg and/or knee of the user.

Still another aspect of the leg rehabilitation strap comprises two (2) long nylon straps to be utilized as a pulling means to aid in the movement of one's leg to simulate motion and resistance and thus aid in the rehabilitation of the leg and knee muscles.

Still a further aspect of the leg rehabilitation strap comprises looped handles to be gripped by a user to allow said user to pull upwardly at various directions and magnitudes on said handles thereby placing tension on the central-receiving member providing said user assistance with walking and rehabilitation. The looped handles may also include various ergonomic features, such as finger indentations, to assist in the gripping by an individual.

An aspect of the leg rehabilitation strap, in an alternate embodiment comprises a foot strap with two (2) separate strap entities in a parallel arrangement thereto equidistantly-spaced therebetween the longitudinal centerline of the central-receiving member. The first and second strap entities are provided with a repeatedly usable fastening means such as, but not limited to: a hook-and-loop fastening system to selectably and releasably secure the first strap entity to the second strap entity.

A method of utilizing the leg stabilizer may be achieved by performing the following steps: selecting a desired leg to be rehabilitated and/or exercised; inserting foot in correspondence with the desired leg within the foot strap; affixing the foot on the central-receiving member utilizing the foot strap elastically providing a snug fit; grasping the looped handle; pulling on the looped handle at the desired magnitude and direction of force for isolation of the muscles, tendons, ligaments, and/or other desirable isolation points of the desired leg; removing the foot upon completion; and, benefiting from the convenience of the leg stabilization device.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
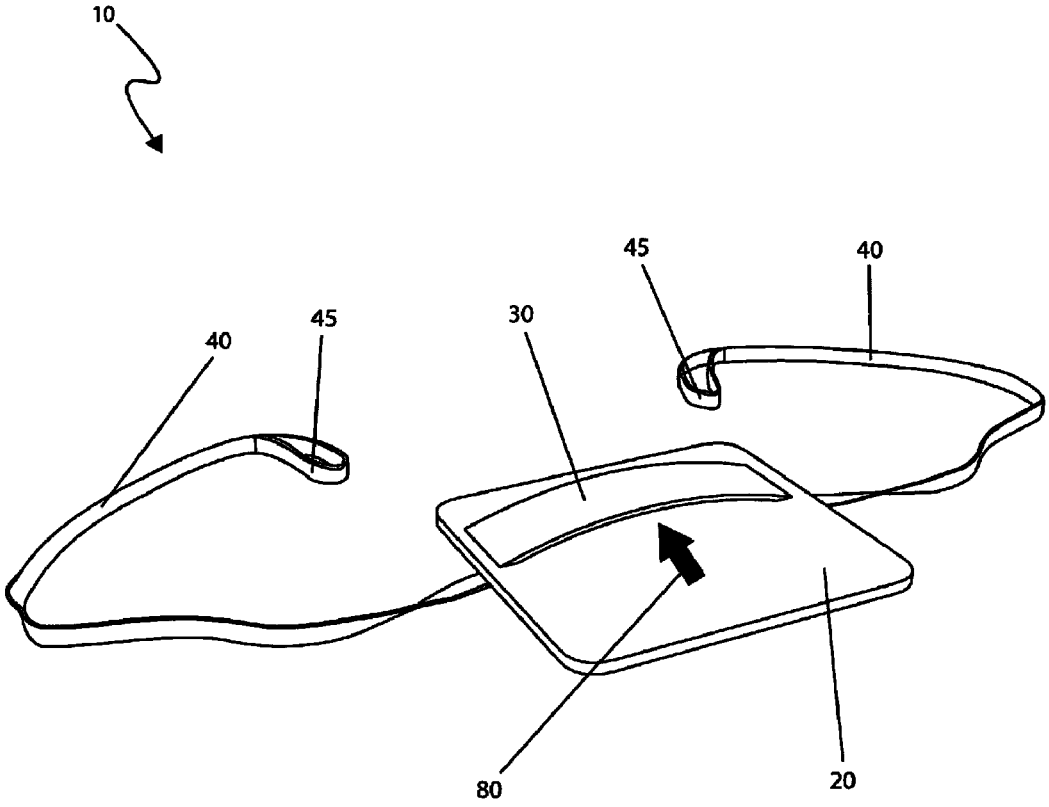
FIG. 1 is a perspective view of a leg rehabilitation strap 10, according to the preferred embodiment of the present invention.

| DESCRIPTIVE KEY | |
|---|---|
| 10 | leg rehabilitation strap |
| 20 | central-receiving member |
| 25 | padding |
| 30 | foot retaining strap |
| 32 | first strap entity |
| 33 | second strap entity |
| 37 | loop fastener strip |
| 38 | hook fastener strip |
| 40 | elastic strap |
| 45 | looped handle |
| 50 | foot |
| 60 | leg |
| 65 | knee |
| 70 | frictional engagement member |
| 80 | insertion direction |
| 90 | force direction |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus comprising a padded central-receiving member 20 that removably receives and retains a foot 50 of the user to assist said user in the bending or motioning of the knee 65 and/or leg area 60 that can be used to increase mobility and/or perform rehabilitation exercises. The leg rehabilitation strap (herein described as the "apparatus") 10 comprises a central-receiving member 20, a foot strap 30, two (2) elastic straps 40, and looped handles 45. The central-receiving member 20 is envisioned to be fabricated of heavy-duty textiles such as nylon, canvas, and/or a combination thereof. The elastic straps 40 are envisioned to be fabricated of an elastic material to allow stretching and retracting thereof. However, it is envisioned that the apparatus 10 may be fabricated of a plurality of textiles that is soft, flexible, comfortable, and lightweight. The various textiles would be die-cut according to a predetermined pattern and sewn together. The straps 30, 40, binding, and the like would be sewn, adhered, integrated, or attached thereto as finishing touches. The apparatus 10 may also be introduced with a variety of aesthetically pleasing decor and/or motifs with or without images such as, but not limited to, cartoon characters, sport logos, and/or other caricatures. It is also envisioned that multiple colors and styles would be made available for the apparatus 10.

Figure 2:
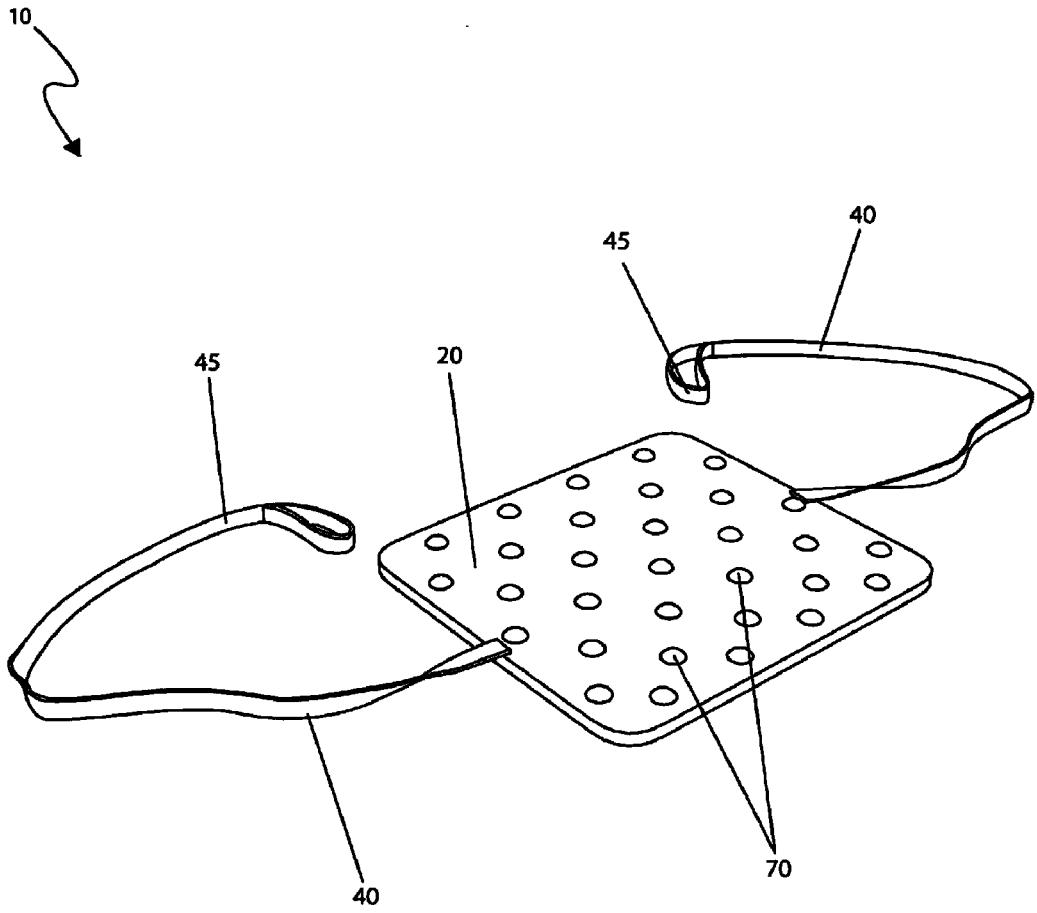
FIG. 2 is an underside side view of the leg rehabilitation strap 10, according to the preferred embodiment of the present invention.

Referring now to FIGS. 1 and 2, views of the apparatus 10, are disclosed according to the preferred embodiment of the present invention. The apparatus 10 is envisioned to be of various sizes and shape so that multiple users comprising various foot sizes may benefit therefrom. The foot 50 of a user is removably received and retained in a central-receiving member 20 preferably, but not essentially, fabricated of a unitary piece of heavy textile with approximate outer dimensions of eight (8) inches by eight-and-one-half (8½) inches. It is envisioned that the central-receiving member 20 to be substantially rectangular in shape in a plurality of dimensions to accommodate users of various feet sizes. However, it will be appreciated that the central-receiving member 20 may also be introduced in a plurality of shapes such as, but not limited to, square, conical, circular, or other shapes. The central-receiving member 20 may also be introduced in a variety of shapes and sizes with or without the option of it being fashioned to resemble effects such as, but not limited to: animals, characters, and/or other images. The central-receiving member 20 is envisioned to be introduced in a variety of and/or combination of durable textiles fabricated from any suitable material having a degree of toughness, providing structural integrity and strength whilst still being comfortable for continuous and repeated use. The central-receiving member 20 may be fabricated of a combination of materials, for instance, one (1) side of said central-receiving member 20 may comprise a softer, durable material with the opposing side being made from a more tough and frictional surface. The softer durable material may be the side at which the user rests upon their foot 50, and the tough and frictional side may be used to engage the floor surface. The tough and frictional side may comprise a plurality of frictional engagement members 70, as depicted in FIG. 2. The frictional engagement means 70 may be embedded thereon the bottom surface and/or the upper surface to enhance a frictional engagement thereto the floor surface and/or the foot 50 of the user.

Figure 3:
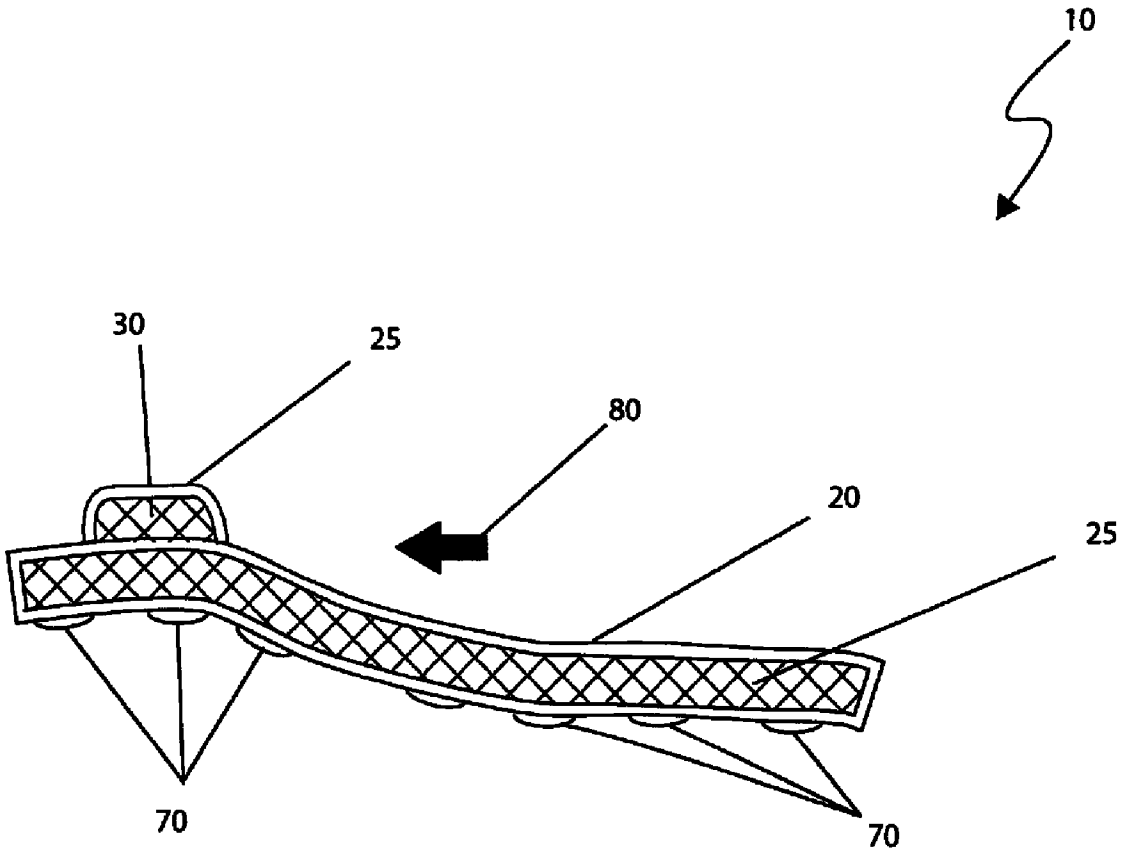
FIG. 3 is a cut-away side of the leg rehabilitation strap 10, according to the preferred embodiment of the present invention.

Referring now to FIG. 3, an interior view of the apparatus 10 is herein disclosed according to the preferred embodiment of the present invention. The central-receiving member 20 is envisioned to be provided initially with a layer of padding 25 covering the entire interior surface. More localized, possibly thicker padding 25 could be used to account for the arch of foot 50, for example. The padding 25 may be fabricated from several different materials such as, but not limited to, foam rubber, cotton, gel cushion, and/or other padding material 25 typically utilized. The central-receiving member 20 is designed for a user to place the sole of one's foot 50 onto at a predetermined position. The central-receiving member 20 may be designed to receive a left foot 50 or a right foot 50 specifically or integrally designed to receive either foot 50 with or without socks and/or shoes.

A foot strap 30 is integrally attached thereto the upper side surface of the central-receiving member 20 for enclosing the foot 50 thereon said central-receiving member 20. The foot strap 30 is formed at a constant width preferably, but not essentially, sized at two-and-one-half (2½) inches wide and coupled thereto the upper surface of the central-receiving member 20 equidistantly spaced therebetween the longitudinal centerline of the central-receiving member 20. However, it will be appreciative that the strap 30 may be a plurality of lengths, widths, and/or other dimensions. The foot strap 30 comprises a distal end and a proximal end. The distal end of the foot strap 30 is attached thereto one (1) upper side surface of the central-receiving member 20, denoted as the upper left side surface for better clarification. The proximal end of the foot strap 30 is attached thereto the opposing upper side surface of the central-receiving member 20, denoted as the upper right side surface for better clarification. Let it be known that the terms "left" and "right" are interchangeable and are only used for better descriptive manners. The distal and proximal ends of the foot strap 30 are attached thereto the upper side surface of the central-receiving member 20 by means of sewing, adhering, gluing, and/or other means of attachment. The means by which the distal and proximal ends of the foot strap 30 are attached provides a means for insertion 80 of the foot 50 therebetween said distal and proximal end. The elastic properties of the foot strap 30 fully encircle the upper surface of the foot 50 in a taut manner thereby limiting undesirable free movement of said foot 50. The foot strap 30 is envisioned to be fabricated of a comfortable material thereby preventing chafing, rubbing, and/or other undesirable affects onto the foot 50 of the user. It is envisioned to be fabricated similarly than to that of the central-receiving member 20 with padding 25 therein.

Figure 4:
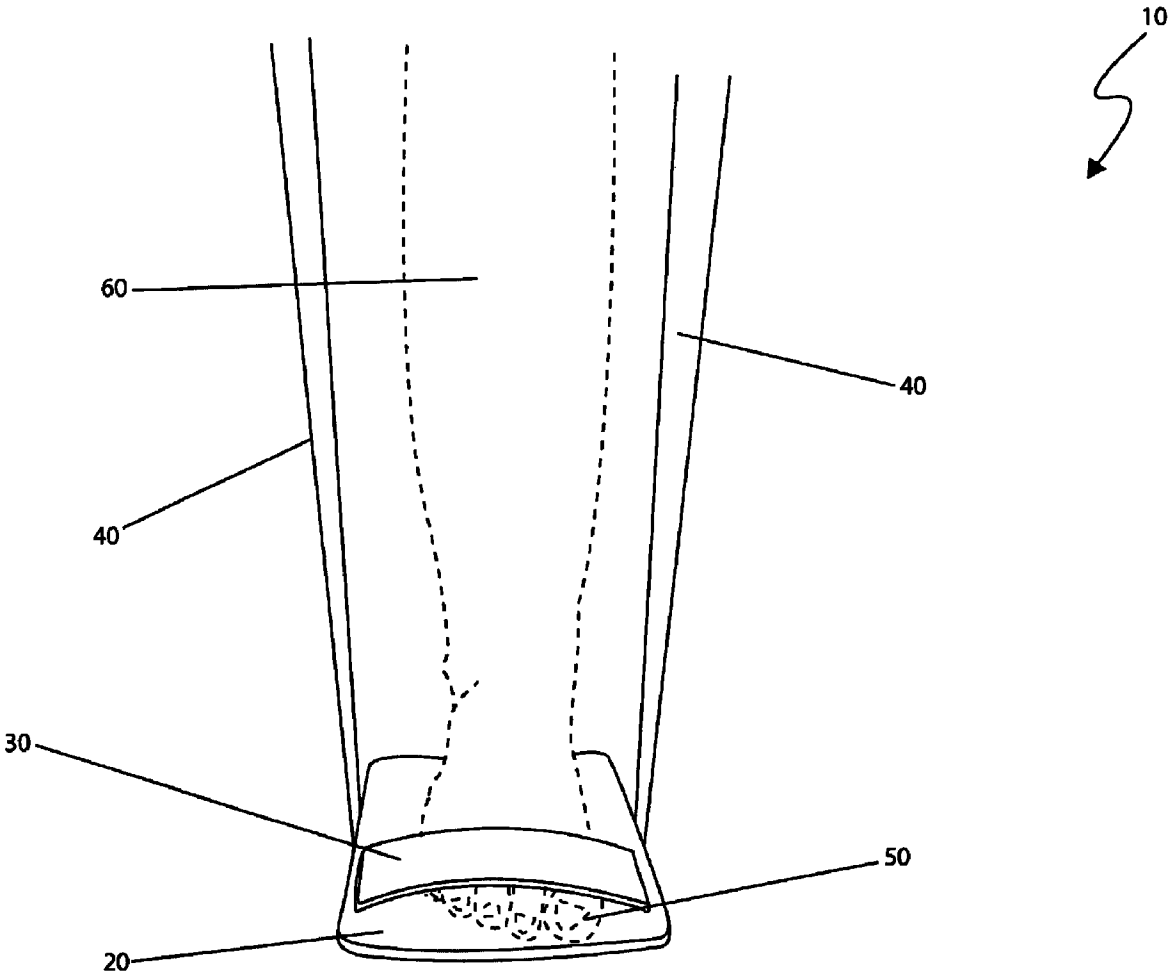
FIG. 4 is a front view of the leg rehabilitation strap 10 with a foot 50 removably inserted therein a foot strap 30, according to the preferred embodiment of the present invention.
Figure 5:
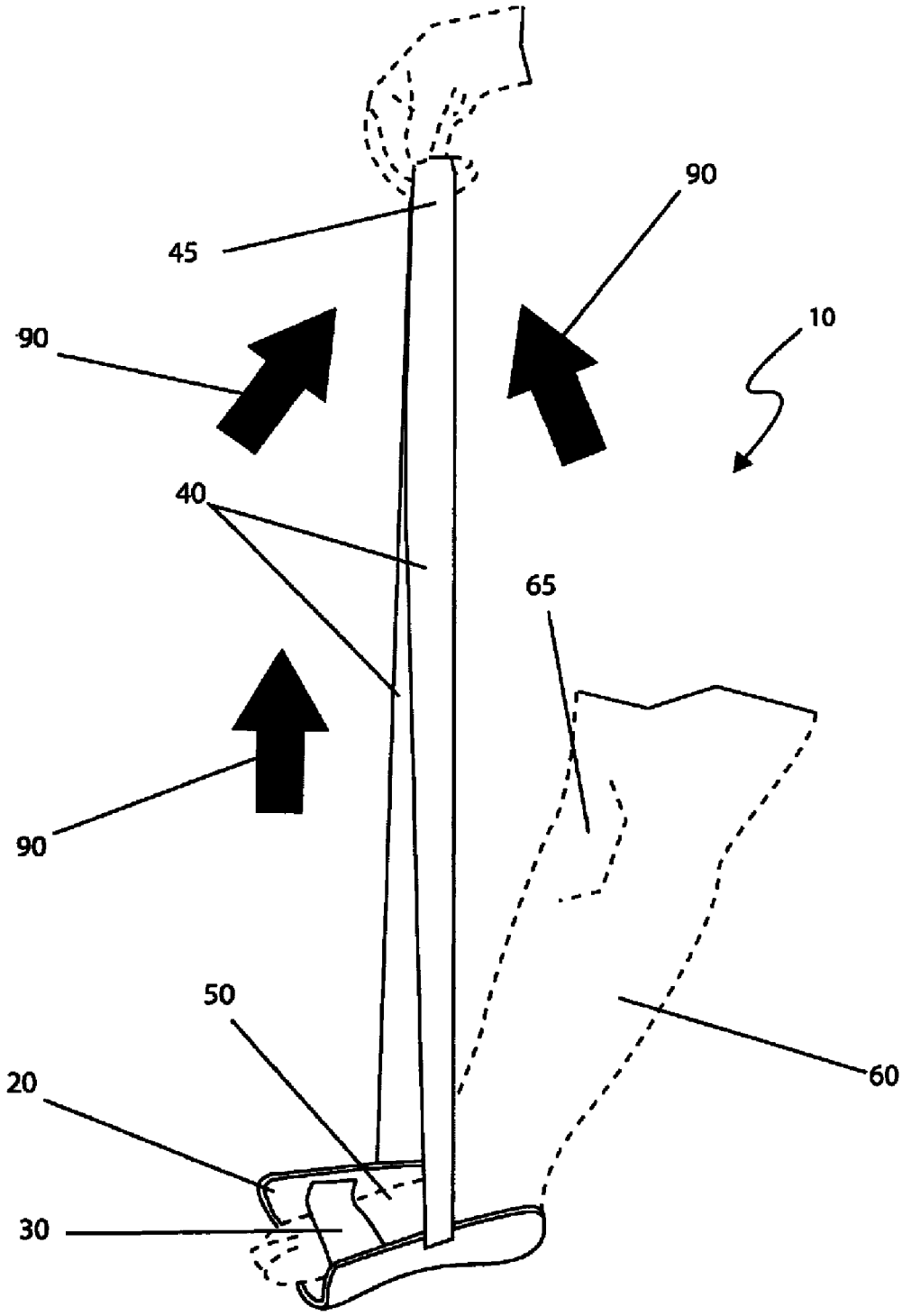
FIG. 5 is a side view of the leg rehabilitation strap 10 with a foot 50 removably inserted therein a foot strap 30, according to the preferred embodiment of the present invention; and, FIG. 6 is a perspective view of the leg rehabilitation strap 10, according to an alternate embodiment of the present invention.

Referring now to FIGS. 4 and 5, views of the apparatus 10, are herein disclosed according to the preferred embodiment of the present invention. Integrally attached thereto the underside surface of the central-receiving member 20 and in a parallel arrangement are elastic straps 40. The straps 40 are envisioned to be shaped with a rectangular cross section having sufficient thickness to provide the necessary structural integrity to withstand the tensile load being applied therethrough. It will be appreciated that the elastic straps 40 may also be formed in alternate shapes such as, but not limited to, tubular having sufficient wall thickness, a solid cylinder, and the like. The two (2) straps 40 preferably have the same length preferably, but not essentially, seventy-five (75) inches and are equidistantly coupled at the distal end thereto the central-receiving member 20 with the proximal ends forming a loop to be utilized as handles 45. The straps 40 may vary in width, materials fabricated, and length in order to provide a greater or lesser pulling force, as required by the particular application. The straps 40 are preferably, but not essentially, elastic, comprising of one (1) or more pieces of durable and resilient material. The symmetric placement of the two (2) straps 40 on opposite sides of the central receiving member 20 acts to balance the apparatus 10 to provide equal amount of force thereon the leg 60 and/or knee 65 of the user. The looped handles 45 may also include various ergonomic features, such as finger indentations, to assist in the gripping by an individual. The distal ends are integrally attached thereto by means of sewing, adhering, gluing, or other means of attachment. By this arrangement, the straps 40 are disposed on one side of a leg 60 of a user and the other is disposed on the opposing side of said leg 60 of said user. The elastic straps 40 securely permit the user to apply a pulling force of various magnitudes onto the foot 50 of the user and consequently the leg 60 and/or knee 65 dependent on the motion and direction 90 of the force being applied. The elastic straps 40 permits the user to control the amount of pulling stress and direction 90 that may be applied thereto the foot 50, and consequently the leg 60 and/or knee 65. The upward pulling of the looped handles 45 yields an angularly upward pull force 90 dependent on the position at which the user is pulling and the amount of pulling force being applied thereto. The user may use the elastic straps 40 to adjustably pull at a desired range of force dependent on the pulling motion 90 applied according to the personal need and/or rehabilitation progress of said user to generate an appropriate pulling stress.

Figure 6:
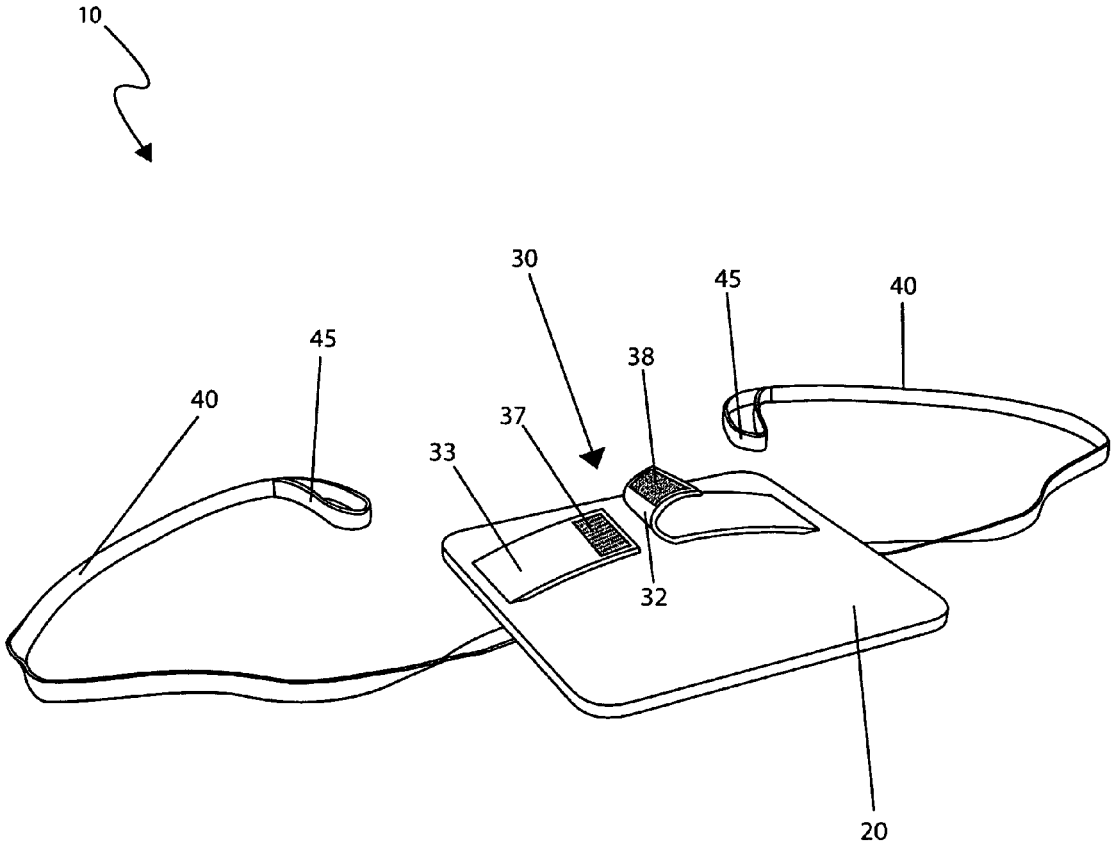

Referring now to FIG. 6, a perspective view of the apparatus 10 is herein disclosed according to an alternate embodiment of the present invention. An alternate embodiment of the present invention may disclose a foot strap 30 with two (2) separate strap entities 32, 33 in a parallel arrangement thereto equidistantly spaced therebetween the longitudinal centerline of the central-receiving member 20. Each strap entity 32, 33, herein described as the first strap entity 32 and second strap entity 33, comprises a distal end and a proximal end. Let it be known that the terms "first" and "second" are interchangeable and are only used for better descriptive measures. The distal ends of the first 32 and second 33 strap entities are attached thereto the upper side surface of the central-receiving member 20 by means of sewing, adhering, gluing, and/or other means of permanent attachment. The proximal ends of the first 32 and second 33 strap entities are free to move so that the user may fitly wrap and locate the foot strap 30 around the upper surface of the foot 50 of a user. The first 32 and second 33 strap entities are provided with a repeatedly usable fastening means such as, but not limited, a hook-and-loop fastening system 37, 38 to selectably and releasably secure the first strap entity 32 thereto the second strap entity 33. The hook-and-loop fastener assembly 37, 38 comprises a hook fastener strip 38 and a loop fastener strip 37 which mates with each other. The hook-and-loop fastener assembly 37, 38 is sewn, integrated, or otherwise attached thereto the respective upper and underside surfaces of the first 32 and second 33 strap entities. A hook fastener strip 38 is envisioned to be installed on the underside surface of the first strap entity 32 and opposes a loop fastener strip 37 installed on the upper surface of the second strap entity 33. It will be appreciated that the positions of the hook fastener strip 38 and the loop fastener strip 37 may be switched. The hook fastener strip 38 is embedded thereto the underside surface of the first strap entity 32 for selectably attaching to the loop fastener strip 37 embedded thereto the upper side surface of the second strap entity 33 thereby providing a loop to encircle the foot 50 of a user. The strap 30 entities rest around the foot 50 and, once fastened, contours thereto said foot 50. The user may place the first 32 and second 33 strap entities around the foot 50 of said user and conveniently adjusting the foot strap entities 32, 33 utilizing the hook-and-loop system 37, 38 to a desired tightness around said foot 50 of said user. Once the hook-and-loop fastener assembly 37, 38 is disengaged thereby extending the strap entities 32, 33, the foot 50 may then be released. Other fastening devices may be used in substitution for the hook-and-loop fastener assembly 37, 38 such as, but not limited to, snaps, buttons, zippers, eyelets and hooks, and the like.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be configured as indicated in FIGS. 1 through 5.

The method of utilizing the apparatus 10 may be achieved by performing the following steps: selecting a desired leg 60 to be rehabilitated and/or exercised; inserting foot 50 in correspondence with chosen leg 60 within the foot strap 30; affixing the foot 50 thereon the central-receiving member 20; utilizing the foot strap 30 elastically providing a snug fit; grasping the looped handle 45; pulling on the looped handle 45 at the desired magnitude and direction 90 of force for isolation of the muscles, tendons, ligaments, and/or other desirable isolation points; and, removing the foot 50 upon completion.

The apparatus 10 provides a means to assist a user in the bending or moving of their knee 65 and/or leg area 60 to increase mobility and/or perform rehabilitation exercises, comprising a central-receiving member 20 for placement of a foot 50 thereon, a foot strap 30 provided to form a sling-like arrangement which holds the textile fabric about the bottom of one's foot 50, and two (2) long nylon straps 40 to be utilized as a pulling means to aid in the movement of ones leg 60 to simulate motion and resistance and thus aid in the rehabilitation of the leg 60 and knee 65 muscles. It can also be used to help those who have no muscle control of their leg 60 to climb a step, get in and out of a car and the like.

The bottom of the user's foot 50 placed upon the central-receiving member 20 and secured via the foot strap 30 functioning so as to prevent said foot 50 from slipping or other undesirable motion. The central-receiving member 20 and the foot strap 30 are constructed of a sewn cover to enclose a padding material 25 therein for a cushioning comfort effect. The looped handles 45 are intended to be gripped by a user to allow said user to pull upwardly at various directions 90 and magnitudes on said handles 45 thereby placing tension on the central-receiving member 20 providing said user assistance with walking and rehabilitation. The elastic straps 40 allow the user to provide unique motions in a variety of directions 90 and at various magnitudes dependent on the needs or rehabilitation progress of the user. The central-receiving member 20 preferably comprises frictional engagement members 70 which functions to prevent slippage on a floor surface. The user may be positioned as sitting, lying down, or standing while operating the apparatus 10. The user may also place their foot 50 with or without socks and/or shoes on therein the foot strap 30. The user then pulls upon the handles 45 thereby drawing the underside surface around the foot 50 toward the body of the user. In use, the looped handles 45 are grasped and extended as needed to manipulate the foot 50 removably received therein the central-receiving member 20 held into place via the foot strap 30. The handle 45 may include a padded material which functions to provide the user additional comfort, which will contribute to allowing the user to extend the duration of walks.

During operation of the apparatus 10, the user may keep their leg 60 fully extended or partially extended dependent on the desired area to be exercised and/or rehabilitated. The upward tension on the elastic straps 40, exerted by the user, stabilizes the foot 50 of said user centrally within the central-receiving member 20. With proper tension on the elastic straps 40, the elastic straps 40 exert an upward force at various angles 90 on the foot 50. The user may then utilize the apparatus 10 to stretch muscles, tendons, ligaments, or the like or utilize the apparatus 10 to assist in the lifting of the foot 50. The apparatus 10 is envisioned to permit upward, downward, sideward, and circular motion of the foot 50 thereby providing optimum strengthening and conditioning exercises. Thus, the person is able to move their foot 50 against the resistance of the elastic straps 40 resulting in a healthy increase of strength to the muscles, tendons, and ligaments surrounding the knee 65 and/or leg area 60.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A leg rehabilitation strap device, comprising:

a receiving member comprising a top surface and a bottom surface;

a foot strap attached to said top surface;

a first elastic strap comprising a first top end and a first bottom end opposite said first top end; and, a second elastic strap comprising a second top end and a second bottom end opposite said second top end;

wherein said first bottom end of said first elastic strap is connected to said receiving member;

wherein said second bottom end of said second elastic strap is connected to said receiving member;

wherein said foot strap is adapted to retain a foot of a user thereon said receiving member to assist said user in a variety of exercises;

wherein said first elastic strap and said second elastic strap allow said user to apply a pulling force thereon said receiving member and consequently thereon said foot, a leg region, and a knee region of said user;

wherein said top surface of said receiving member further comprises a plurality of frictional engagement members;

wherein said bottom surface of said receiving member further comprises a plurality of frictional engagement members;

wherein said receiving member is deformably resilient and formed from flexible material, wherein said frictional engagement members are juxtaposed along a plurality of rows and columns extending along a periphery of said bottom surface of said receiving member, each of said frictional engagement members having a dome-shape, wherein said receiving member is bent from a substantially planar shape to a concave shape when said first and second elastic straps are pulled to a tensioned position.

2. The device of claim 1, wherein said first bottom end of said first elastic strap is connected to said receiving member thereat a first periphery edge of said bottom surface.

3. The device of claim 2, wherein said first bottom end of said first elastic strap is connected to said receiving member thereat a first periphery edge of said bottom surface by one (1) of the following methods: sewing, adhering, or gluing.

4. The device of claim 1, wherein said second bottom end of said second elastic strap is connected to said receiving member thereat a second periphery edge of said bottom surface.

5. The device of claim 4, wherein said second bottom end of said second elastic strap is connected to said receiving member thereat a second periphery edge of said bottom surface by one (1) of the following methods: sewing, adhering, or gluing.

6. The device of claim 1, wherein said receiving member further comprises a layer of padding.

7. The device of claim 6, wherein said layer of padding comprises one (1) of the following: a foam rubber, a cotton cushion, or a gel cushion.

8. The device of claim 1, wherein said device is capable of receiving a left foot or a right foot of said user.

9. The device of claim 1, wherein said receiving member comprises a nylon material.

10. The device of claim 1, wherein said receiving member comprises a canvas material.

11. The device of claim 1, wherein said foot strap is attached to said top surface by one (1) of the following methods: sewing, adhering, or gluing.

12. The device of claim 1, wherein said foot strap further comprises a layer of padding.

13. The device of claim 1, wherein said first top end of said first elastic strap forms a first loop to be utilized as a first handle.

14. The device of claim 1, wherein said second top end of said second elastic strap forms a second loop to be utilized as a second handle.

* * * * *